US005105126A

United States Patent [19]

Whitesel

[11] Patent Number: 5,105,126

[45] Date of Patent: Apr. 14, 1992

[54] BRIGHTNESS CONTROL FOR FLASHING XENON LAMP

[75] Inventor: Lawrence E. Girard Jr., Windsor Locks, Conn.

[73] Assignee: Cooper Industries, Inc., Houston, Tex.

[21] Appl. No.: 518,924

[22] Filed: May 4, 1990

Related U.S. Application Data

[63] Continuation-in-part of Ser. No. 464,907, Jan. 16, 1990.

[51] Int. Cl.[5] ..... H05B 41/34

[52] U.S. Cl. ..... 315/241 R; 315/224; 315/225

[58] Field of Search ..... 315/241 R, 241 S, 241 P, 315/225, 224, 200 A; 340/331, 951-956

[56] References Cited

U.S. PATENT DOCUMENTS

| | | | |
|---|---|---|---|
| 3,716,752 | 2/1973 | Iwata | 315/241 P |
| 3,753,039 | 8/1973 | Bonazoli | 340/956 |
| 4,005,337 | 1/1977 | Rabe | 315/241 S |
| 4,233,546 | 11/1980 | Berthiaume | 315/241 R |
| 4,325,008 | 4/1982 | Borland | 315/241 R |
| 4,392,088 | 7/1983 | Hartai | 315/241 R |
| 4,449,073 | 5/1984 | Mongoven | 315/130 |

*Primary Examiner*—Eugene R. LaRoche
*Assistant Examiner*—A. Zarabian
*Attorney, Agent, or Firm*—Laff, Whitesel, Conte & Saret

[57] ABSTRACT

The invention provides a brightness control circuit for a periodically flashing xenon lamp. The intensity of the flashing lamp may be selected in response to the selection of a reference voltage. The control circuit has a power source in series with a thristor for selectively controlling an application of a voltage from a power source to a xenon lamp. A capacitor is coupled substantially in parallel with the xenon lamp in order to apply a voltage across the lamp. A comparator is responsive jointly to a charge level on the capacitor and a reference voltage. The comparator switches on/off the thyristor so that the switching voltage may be selected by selecting the reference voltage, thereby selecting the intensity of the reference voltage. The flashing lamp in this particular application is part of an airport runway approach system.

12 Claims, 1 Drawing Sheet

BRIGHTNESS CONTROL FOR FLASHING XENON LAMP

This is a continuation-in-part of Ser. No. 07/464,907, filed Jan. 16, 1990.

This invention relates to means for and methods of brightness control for flashing xenon lamps and more particularly to circuits for controlling such lights when used for airport runway approach control.

Flashing runway approach lights are required to operate at three different intensity levels, depending upon the prevailing visibility conditions. These systems almost invariably use a xenon lamp source having a capacitor-discharge power supply. The lamp energy (in joules) is defined by:

$$\text{Joules} = \tfrac{1}{2}CV^2$$

Where:

C is a capacitor value

V is the voltage across the capacitor

Therefore, the energy of the lamp flash and thereby the intensity may be altered by changing either the capacitor value or the voltage which is applied across the capacitor. One patent dealing with this subject (U.S. Pat. No. 3,780,344) describes a photographic flash lamp. Other patents are: U.S. Pat. Nos. 2,946,924; 3,634,725; 3,644,818; 3,735,238; 3,783,337; 3,792,309; 4,005,337; 4,392,088.

A long-standing method which has been used to alter the flash intensity switches between several capacitor values. (U.S. Pat. No. 3,792,309). This election to change capacitor values is, in part, due to the minimum voltage which must be applied across the xenon lamp in order to strike an arc. Typically 40% to 50% of the rated operating voltage is required to strike the arc.

An alternative method of intensity control involves switching the primary windings on a transformer, thereby changing the level of the voltage applied to the capacitor. To overcome the lamp minimum strike voltage problem, a second capacitor of a much lower value is changed to 50% of the rated lamp voltage and then is injected into the main discharge path, via a solid state diode logic circuit. There are disadvantages with both of these methods of lamp intensity control. Mainly, there is a lack of supply voltage regulation. Also an unduly large number and size of parts are required.

Accordingly, the prior art has taught that it was not economically feasible to use a circuit for controlling the voltage in order to vary the lamp intensity.

An object of the invention is to provide new and improved control circuits for varying the intensity of xenon lamps. Here an object is to provide a control circuit which may vary the flash intensity by changing the level of a voltage which is applied across a xenon lamp to produce the flash.

In keeping with an aspect of the invention, these and other objects are accomplished by a brightness control circuit for firing a xenon lamp at any of several different levels of intensities. The control circuit includes a power source, having a thyristor for selectively controlling an application of the output voltage of the power source to an energy storage capacitor. The capacitor is coupled substantially in parallel with both the xenon lamp and the power source. A control circuit is connected to the capacitor in order to monitor a voltage which is applied across the lamp. The thyristor is switched on jointly responsive to a reference voltage and a charge level on the capacitor. Therefore, the level of the switch on voltage may be selected by selecting the level of the reference voltage, and that in turn selects the intensity level of the lamp.

BRIEF DESCRIPTION OF DRAWINGS

A preferred embodiment of the invention is shown in the attached drawings, wherein.

Figure 1:
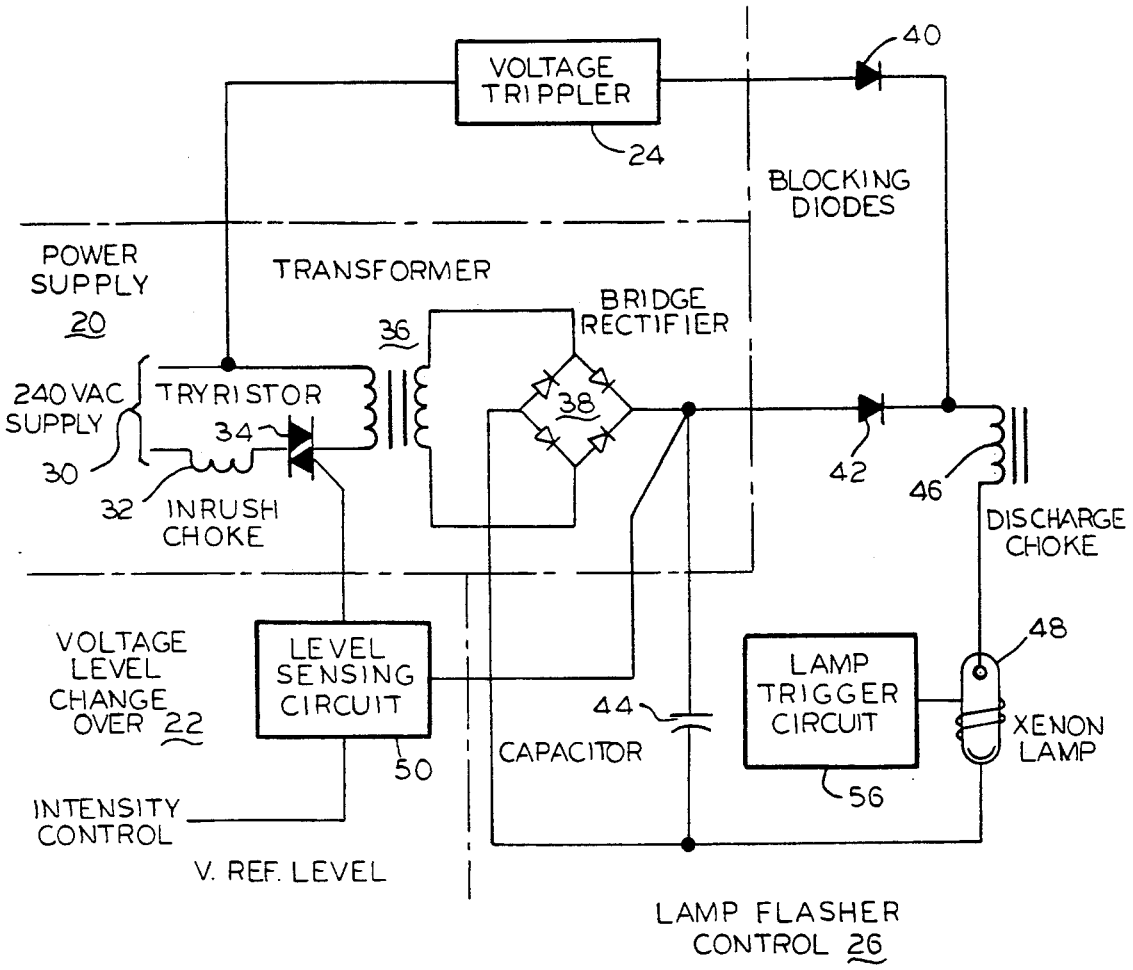
FIG. 1 is a simplified circuit drawing which shows the principles of the invention.

The principal parts of the inventive circuit (FIG. 1) are a power supply circuit 20, a voltage level change over control circuit 22, a voltage trippler 24, and a lamp flasher control circuit 26.

The power supply circuit 20 comprises a 240 volt source coupled through a inrush choke coil 32 and a thyristor 34 to the primary of a transformer 36. The secondary of the transformer 36 is coupled to a full wave rectifier bridge 38. The inrush choke coil 32 is a constant voltage, current limiting device.

The primary winding of the transformer 36 is coupled to a voltage trippler circuit 24. The voltage trippler is provided to establish a minimum firing voltage required by the xenon lamp. In one example, the voltage trippler provided a thousand volts which could be applied across the lamp. This high voltage level is only required to fire the lamp. It is not required to sustain the lamp.

The lamp flasher control circuit 26 includes two isolation diodes 40, 42 which are provided to enable both the voltage trippler 24 and the rectifier bridge 38 to feed a voltage into the xenon lamp flasher control circuit 26. The capacitor 44 is connected across discharge coil 46 in series with a xenon lamp 48. Together capacitor 44 and coil 46 form a circuit which controls the duration of the flashes of the lamp. The lamp trigger circuit 56 is a standard commercial circuit which includes a pulse generator that periodically triggers or switches on the lamp.

Figure 2:
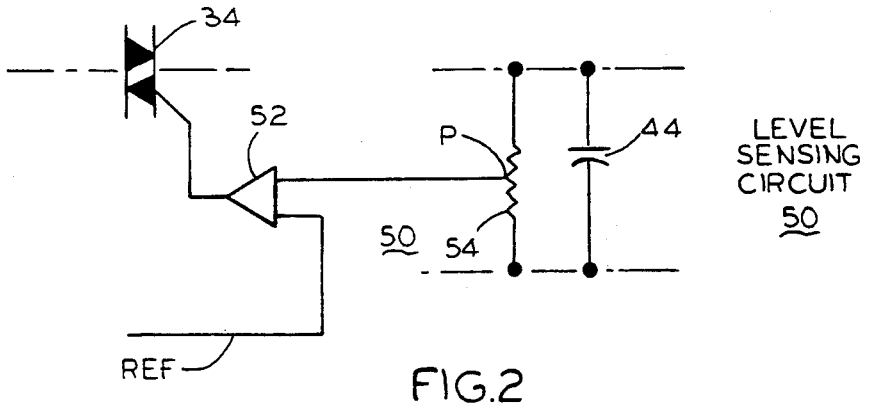
FIG. 2 is a schematic circuit diagram showing more details of a level sensing circuit.

Details of the level sensing circuit 50 are shown in FIG. 2. An operational amplifier 52, used as a comparator, has a first input which is coupled to a potential point P on a voltage divider 54 which is connected in parallel with capacitor 44. The potential at point P proportionally represents the level of the voltage charge that is built upon capacitor 44, as it cyclically charges and discharges. A reference voltage REF is applied to the other input of the operational amplifier 52. The output of the operational amplifier switches thyristor 34 on/-off, which causes it to conduct for a period of time to initiate and time a cycle of the lamp flashing process. Hence, the thyristor 34 may be fired at a voltage which is selected and changed in response to a selection of the reference voltage level REF.

The circuit operates this way. When the thyristor turns on, the inrush choke 32 appears to have a constant voltage applied across it while the building of the magnetic field around the choke acts as a current limiter. The circuit timings are such that this constant voltage, current limiting condition decays as the capacitor 44 charges. The current limiting by inrush choke prevents excessive currents in the primary winding of transformer 36. The common practice of providing such current limiting would be to insert a resistor in the circuit connected to the secondary winding. Such a limiting resistor wastes energy and increases operating costs.

At the beginning of a cycle, no voltage is built upon capacitor 44 so that the potential at point P is lower than the reference voltage REF. In this condition, the amplifier 52 conducts to fire thyristor 34, and apply line voltage to the primary winding of transformer 36. The resulting output at the secondary winding of the transformer 36 is rectified and applied across the capacitor 44. The charge building upon capacitor 44 rises the potential at point until it reaches a level relative to the potential of the reference voltage REF which turns off the amplifier 52, and in turn the thyristor 34. The charge actually built upon the capacitor 44 may be higher or lower depending upon the potential level of the voltage REF. When it is higher, there is more energy to cause a brighter flash of the xenon lamp.

When the capacitor 44 is discharged and a voltage is applied across it, its charging current makes it appear as a short circuit across the lamp 48, robbing it of its ignition voltage. When the capacitor is fully charged, current no longer passes through it, and the full voltage on the charged capacitor is applied across the xenon lamp. When the lamp fires, it appears to be a short circuit, discharging the capacitor. Upon the discharge of capacitor 44, the amplifier 52 switches on to again fire thyristor 34 and restarts the cycle. After discharge, the capacitor 44 again appears as a short circuit across the lamp.

The discharge choke 46 limits the rate at which the discharge current from the capacitor passes through the xenon lamp in order to sustain its discharge, thereby establishing the duration and intensity of the flash.

The level sensing circuit 50 (FIG. 2) controls the intensity of the lamp flash by comparing the potential at point P with the potential level of the reference voltage REF. In greater detail, the potential at point P is applied to the upper input of operational amplifier 52. Before the charge on capacitor 44 builds the potential at point P to a predetermined level relative to a potential voltage REF, the operational amplifier 52 conducts to switch on the thyristor 34. After the potential at point reaches the predetermined level, amplifier 52 switches off, to turn off the thyristor 34 and to terminate the charging of capacitor 44. Thus, the firing and on/off switching of thyristor 34 is a joint function of the potential of the reference voltage and the potential built upon the capacitor 44. If the potential of the REF voltage is low, the thyristor 34 turns off sooner; if it is high, the thyristor 34 turns off later. These differences in the level of the voltage built upon the capacitor 44 determine the duration and the intensity of the flash.

The advantages of the inventive control circuit should now be clear. First, the control circuit is all solid state, without any relays. Therefore, there is greater reliability. Second, there are no contacts to require cleaning. Third, the close voltage regulation provided by the control circuit insures a more uniform and predictable light intensity for each flash.

Those who are skilled in the art will readily perceive how to modify the invention. Therefore, the appended claims are to be construed to cover all equivalent structures which fall within the true scope and spirit of the invention.

The claimed invention is:

1. An adjustable brightness control circuit for a flashing xenon lamp, said circuit comprising a lamp flashing control circuit for causing said lamp to flash at either of at least two light intensity levels, a power supply circuit including switching means and a transformer having at least primary and secondary windings for applying energy from said power supply circuit to said lamp flashing control circuit, means for supplying a reference potential at a selected voltage level corresponding to one of said light intensity levels, voltage level sensing means for comparing said selected reference potential with a level of energy received by said lamp flashing control circuit and for switching said switching means on/off in response to said comparison, said switching means switching off said energy supplied to said lamp flashing control circuit a period of time after it starts, the duration of said period of time and therefore the intensity of the flash depending upon the selected voltage level of said reference potential, and means comprising a voltage multiplier coupled between said primary winding and said lamp to supply a striking voltage for striking said lamp near a start of said period of time after said power supply energy reaches said flashing control circuit.

2. The circuit of claim 1 and a capacitor coupled in parallel with at least said lamp for supplying a potential to said level sensing means which is representative of said energy supplied by said power supply means.

3. The circuit of claim 2 wherein said level sensing means is an amplifier having an input coupled to receive said reference potential and another input coupled to a potential point on a voltage divider which reflects the charge that is built upon said capacitor.

4. The circuit of claim 3 and means for sustaining said lamp responsive to a discharging of said capacitor after said switching means switches off said energy supplied to said lamp from said power supply.

5. An adjustable brightness control circuit for xenon lamp, said control circuit comprising a power source including a transformer having primary and secondary windings, means including a thyristor for selectively controlling an application of an output from said power source to a circuit including a xenon lamp, capacitor means coupled substantially in parallel with at least said xenon lamp in order to monitor a voltage applied across said lamp, means for providing a reference voltage of at a selected one of at least two voltage levels, a voltage multiplier coupled between said primary winding and said lamp to supply a striking voltage, and means responsive jointly to a charge level on said capacitor and to the selected voltage level of said reference voltage for switching on and off said thyristor, whereby the switch on and off voltage may be selected by selecting said reference voltage, thereby selecting the intensity of the lamp flash.

6. The circuit of claim 5 and a voltage divider coupled in parallel with said capacitor, said means for jointly controlling the charge level on said capacitor comprising a comparator having two inputs and a output, one input of said comparator being coupled to a potential point on said voltage divider, the other input of said comparator being coupled to said reference voltage, and the output of said comparator being coupled to control the switching of said thyristor.

7. The circuit of claim 6 and a choke coil coupled in a series circuit with said lamp, said capacitor being coupled in parallel with said series circuit.

8. The circuit of claim 7 and a choke coil coupled in series with said thyristor, said transformer having said primary winding coupled to said thyristor and its series choke coil and having said secondary winding coupled to supply energy to said capacitor and said lamp with its series choke coil.

9. The circuit of claim 1 and means for cyclically striking said lamp so that said lamp flashes at periodically recurring intervals.

10. The control circuit of claim 1 wherein there are three of said reference potentials to select from in order to provide one of three optional levels of flash intensity.

11. The control circuit of claim 10 and a voltage comparator, said potentials comparator having two inputs and an output, one of said inputs being coupled to receive said reference voltage, the other input being coupled to receive a potential having a periodically increasing voltage level applied to said lamp, and an output of said comparator being coupled to supply a control signal to said lamp.

12. The control circuit of claim 11 wherein said xenon lamp having a capacitor coupled in a circuit parallel therewith, and a voltage divider connected across said capacitor to supply said periodically increasing potential.

* * * * *